United States Patent [19]

van Mullekom

[11] Patent Number: 4,887,649

[45] Date of Patent: Dec. 19, 1989

[54] WEFT BOBBIN CHANGER FOR A LOOM

[75] Inventor: Hubert P. van Mullekom, Deurne, Netherlands

[73] Assignee: Sulzer Brothers Limited, Winterthur, Switzerland

[21] Appl. No.: 201,688

[22] Filed: Jun. 2, 1988

[30] Foreign Application Priority Data

Jun. 25, 1987 [CH] Switzerland ..... 390/87

[51] Int. Cl.[4] ..... D03D 47/34; B65H 67/02; B65H 69/02

[52] U.S. Cl. ..... 139/450; 139/452; 139/224 A; 242/35.6 R

[58] Field of Search ..... 242/35.6 R, 35.6 E; 139/450, 452, 453, 435, 224 R, 224 A, 225, 228, 256 R, 256 A, 257, 260, 263; 66/125 R

[56] References Cited

U.S. PATENT DOCUMENTS

| | | | |
|---|---|---|---|
| 3,358,941 | 12/1967 | Jenny | 242/35.6 |
| 3,377,676 | 4/1968 | Furst | 242/35.6 R |
| 3,926,224 | 12/1975 | Vermeulen et al. | 139/452 X |
| 4,667,705 | 5/1987 | Nijhuis et al. | 139/453 X |

FOREIGN PATENT DOCUMENTS

| | | | |
|---|---|---|---|
| 0226464 | 6/1987 | European Pat. Off. . | |
| 891516 | 9/1953 | Fed. Rep. of Germany . | |
| 2700974 | 7/1978 | Fed. Rep. of Germany . | |
| 0082446 | 5/1984 | Japan | 139/452 |

*Primary Examiner*—Andrew M. Falik
*Attorney, Agent, or Firm*—Kenyon & Kenyon

[57] ABSTRACT

The weft bobbin changer comprises a bobbin turntable comprising a delivery bobbin and at least one reserve bobbin. A sensor continuously monitors the quantity of yarn on the delivery bobbin. Only when the adjustable minimum quantity of yarn on the delivery bobbin has been reached is a piecing-up operation performed to join the yarn of the deliver bobbin to the yarn of the reserve bobbin. The yarn of the previous delivery bobbin being severed between the delivery bobbin and a yarn joint which has been or will be made is such that the previous reserve bobbin becomes the new delivery bobbin. The minimum yarn quantity for high-quality fabrics can therefore be greater than previously without loss of material and the yarn residues left on the bobbin can be further processed in lower-quality products.

21 Claims, 2 Drawing Sheets

5
20
21
55
56
56'
573
572
53
53'
53"
531
530
571
571'
230
73
71
72
2123
151
15
23
13

WEFT BOBBIN CHANGER FOR A LOOM

This invention relates to a weft bobbin changer for a loom.

As is known, weft bobbin changers have been used in weaving with a view to minimizing production interruptions in looms due to a lack of weft yarn. In conventional changers, the end of a yarn from a delivery bobbin is pieced-up to the start of a yarn from a reserve bobbin in any desired manner, for example, by knotting or splicing or sticking. Generally, this piecing-up operation is performed manually. Once the yarn of the delivery bobbin has been consumed, the reserve bobbin becomes the delivery bobbin and the new delivery bobbin is moved, for example into the delivery position.

The duration of a weft yarn bobbin of, for example, 100 kilometers is approximately one hour in high speed looms having high picking rates of approximately 1500 meters/minute. Often, the weft bobbin changer is comprised, for example, of a circular plate having a number of skewers for weft bobbins with the yarns of the multiple reserve bobbins being pieced up one after another. The loom, therefore, has available a weft yarn reserve sufficient for a considerably prolonged period of time. Consequently, individual shifts, for example, night shifts, in a weaving shed can be operated with a reduced number of staff.

In some fabrics, the junction between two weft yarn bobbins—i.e., the knot or splice or adhesion joint in the fabric—would produce an unsatisfactory defect. For example, Japanese published Patent Application No. 50 895-85 describes a weft bobbin changer in which the yarn reserve of the delivery bobbin is monitored by an optical sensor which is operative since the bobbin core has reflection properties which are markedly different from the yarn material. Also, a sensor is provided to detect the passage of the joint between the delivery bobbin yarn end and the reserve bobbin yarn start. When the monitoring facility of the supply on the delivery bobbin detects, i.e.,—sees the bobbin member or reel, the loom is stopped and the residue of yarn on the delivery bobbin is, together with the joint with the reserve bobbin yarn, blown, for example, into a waste duct and is not woven into the fabric. The additional sensor detects when the joint has been blown away, whereafter weaving is resumed. This method leads to relatively high wastage of material, a consideration which is more important in proportion as the weft material is more costly and the quantity of yarn on the weft bobbin is smaller. These disadvantages become very serious in the case of weft materials such as glass yarns for special fabrics in which a relatively large number of the innermost layers of the delivery bobbins must not be processed if defects in the fabric, such as striping, are to be avoided. The material losses arising with this kind of weft bobbin changer in the method disclosed in the Japanese published patent application may be fairly substantial. Also, if there is more than one reserve bobbin, relatively complex and costly measures are necessary.

Accordingly, it is an object of the invention to provide a weft bobbin changer which can be operated automatically.

It is another object of the invention to reduce the amount of waste in piecing-up bobbins in a bobbin changer.

It is another object of the invention to provide a weft bobbin change which can be operated in a reliable manner.

Briefly, the invention provides a weft bobbin changer for a loom which includes at least one delivery bobbin for supplying a weft yarn and at least one reserve bobbin containing a weft yarn. In addition, the changer has a sensor which is responsive to the quantity of weft yarns on the delivery bobbin, a control means connected to the sensor and piecing-up means which is responsive to the control means for piecing up a yarn from the reserve bobbin with a yarn from the delivery bobbin in response to an adjustable minimum quantity of weft yarn being reached on the delivery bobbin.

Still further, the changer includes a yarn severing device for severing the weft yarn from the delivery bobbin downstream of a point of connection with the weft yarn from the reserve bobbin.

One advantage of the bobbin changer is that the delivery bobbin residue which is not to be woven into a fabric remains on the bobbin or reel and is, therefore, available for further processing. The material, thus, does not have to finish up as tangled waste.

As a rule, stripings in fabrics start not abruptly but gradually as the reserve on a delivery bobbin decreases. The weft bobbin changer permits a higher quality requirement to be met due to the residue on the delivery bobbin at a bobbin change being greater. This residue can be further processed in lower-quality products.

The piecing-up means may be of any suitable construction, for example, a knotter or splicer or a sticking device. Further, the piecing-up means operates to connect the start of the reserve bobbin yarn to the yarn running off the delivery bobbin only at the instant of the necessary bobbin change and not to the end of the delivery bobbin yarn as is the case with conventional weft bobbin changes. Further, an adhesive connection may be made between the yarns, particularly, in the case of the piecing-up of glass or carbon fiber yarns.

The weft bobbin changer permits the use of a simple robot to remove the residual bobbins, for example, from skewers and to top the system up with new full weft bobbins.

These and other objects and advantages of the invention will become more apparent from the following detailed description taken in conjunction with the accompanying drawings wherein:

FIG. 1 diagrammatically illustrates a perspective view of a weft bobbin changer constructed in accordance with the invention;

Figure 5:
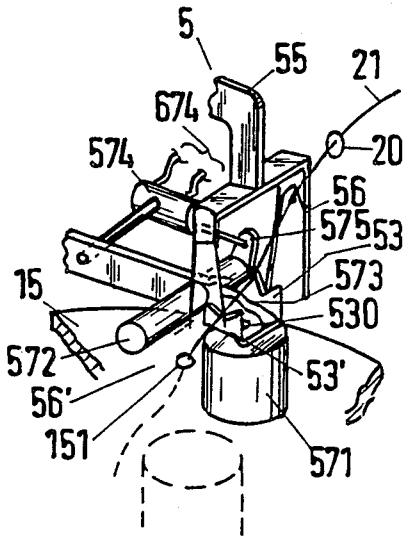
FIG. 5 illustrates a view of the piecing-up means turned 90° from the position shown in FIG. 2.
Figure 1:
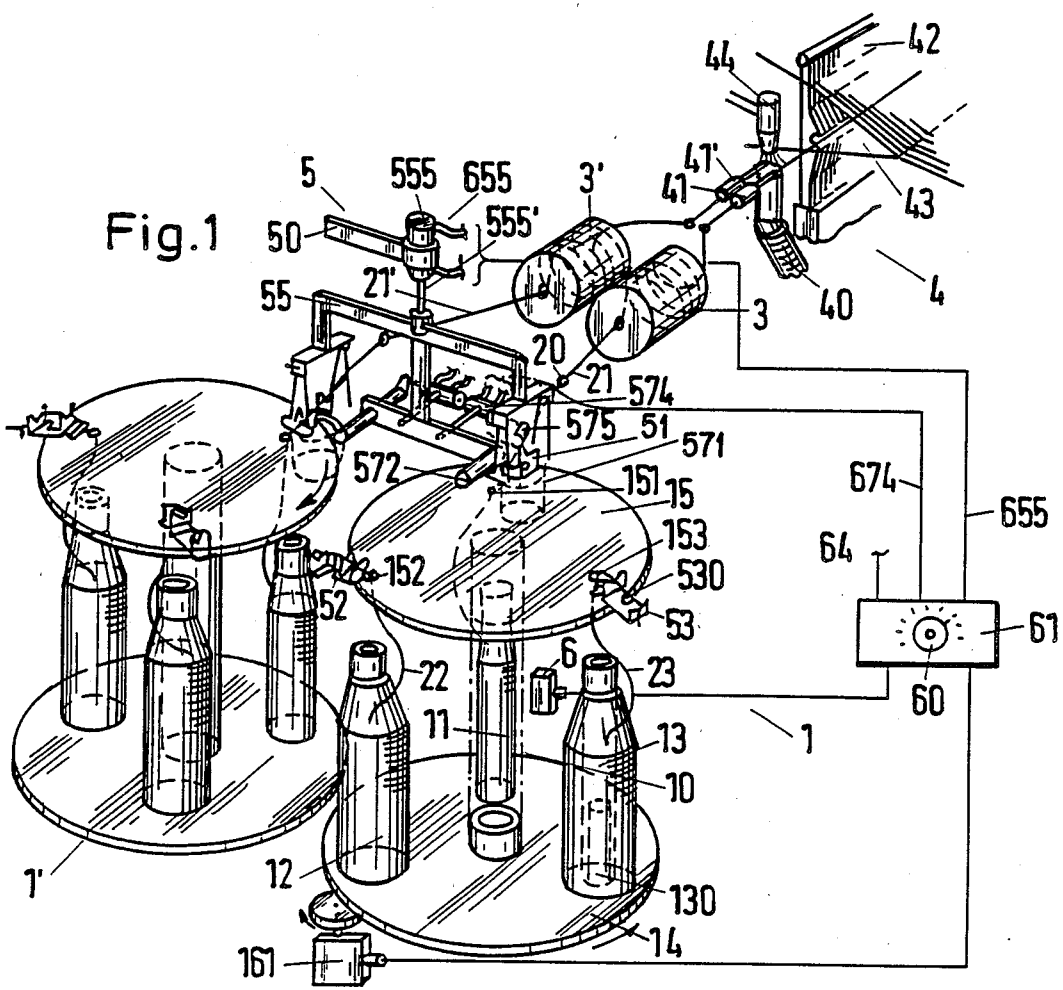

Referring to FIG. 1, the loom or weaving machine is provided with a pair of weft bobbin changers 1, 1' from which respective yarns 21, 21' pass to yarn stores 3, 3' for subsequent delivery to an air jet loom 4. As indicated, the loom 4 includes a pair of main nozzles 41, 41' and a reed 42 which cooperates with a shed 43 formed of warp yarns. In addition, a nozzle 44 and an associate suction duct 40 are provided for the removal of yarn residues.

The weft bobbin changers 1, 1' are of identical construction and operate on the same principle. Accordingly, the construction and operation of only the right-hand weft bobbin changer 1 will be further described. Of note, the yarns 21, 21' may be picked into the shed 43 alternately or in a predetermined pattern.

The weft bobbin changer 1 includes a delivery bobbin 11 and two reserve bobbins 12, 13 which are placed on skewers, of which only the skewer 130 for the reserve bobbin 13 is illustrated. The skewers are mounted on the turntable 14 which is connected by way of a spindle 10 to a disk 15 at the upper end for co-rotation therewith. The weft yarn 21 of the delivery bobbin 11 extends through a yarn guide 151 at the top of the disk 15 and then passes through other guide elements, past a yarn retaining element 51 to a yarn store 3 and a nozzle 41 to the shed 43. The yarns 22, 23 of the two reserve bobbins 12, 13 go through respective yarn guides 152, 153 in the disc 15 to respective yarn retaining elements 52, 53 and are clamped fast thereto. The yarn retaining elements 51, 53 form part of a yarn piecing-up means and, in shape, resemble a U whose two arm ends are in the form of V-shaped guide teeth.

A means for measuring the quantity of weft yarn on the delivery bobbin 11 includes a sensor 6 to measure the diameter of the winding over a predetermined length of the bobbin. Sensors of this kind, for example, optical sensors, based on the reflection and/or shade—i.e., transillumination—principle are known and readily available in commerce. Once the minimum quantity of yarn on the delivery bobbin has been detected, such quantity having been preset and preselected on a loom-controlling means 61, for example, by means of a knob 60, the loom is stopped by way of a signal line 64 which extends to the loom control (not shown).

When the loom is stopped, a motor 161 is actuated to rotate the discs 14, 15 anticlockwise so that the reserve bobbin 13 moves into the position of the delivery bobbin 11, whereafter, the same takes up the position of the delivery bobbin 12. Simultaneously, the weft yarn 21 of the delivery bobbin 11 moves exactly over the guide teeth of the retaining element 53 to which the yarn 23 of the reserve bobbin 13 has been secured.

FIGS. 2 to 5 show the situation after the discs 14, 15 have rotated, the reserve bobbin 13 being in the position of the delivery bobbin. The yarn 23 of bobbin 13 is disposed in the two guide teeth 53', 53" of the element 53 and a yarn start 230 is between the outer side surface of the—from the radial point of view—outer guide tooth 53" and a moving roller 531.

Figures 2, 3, 4:
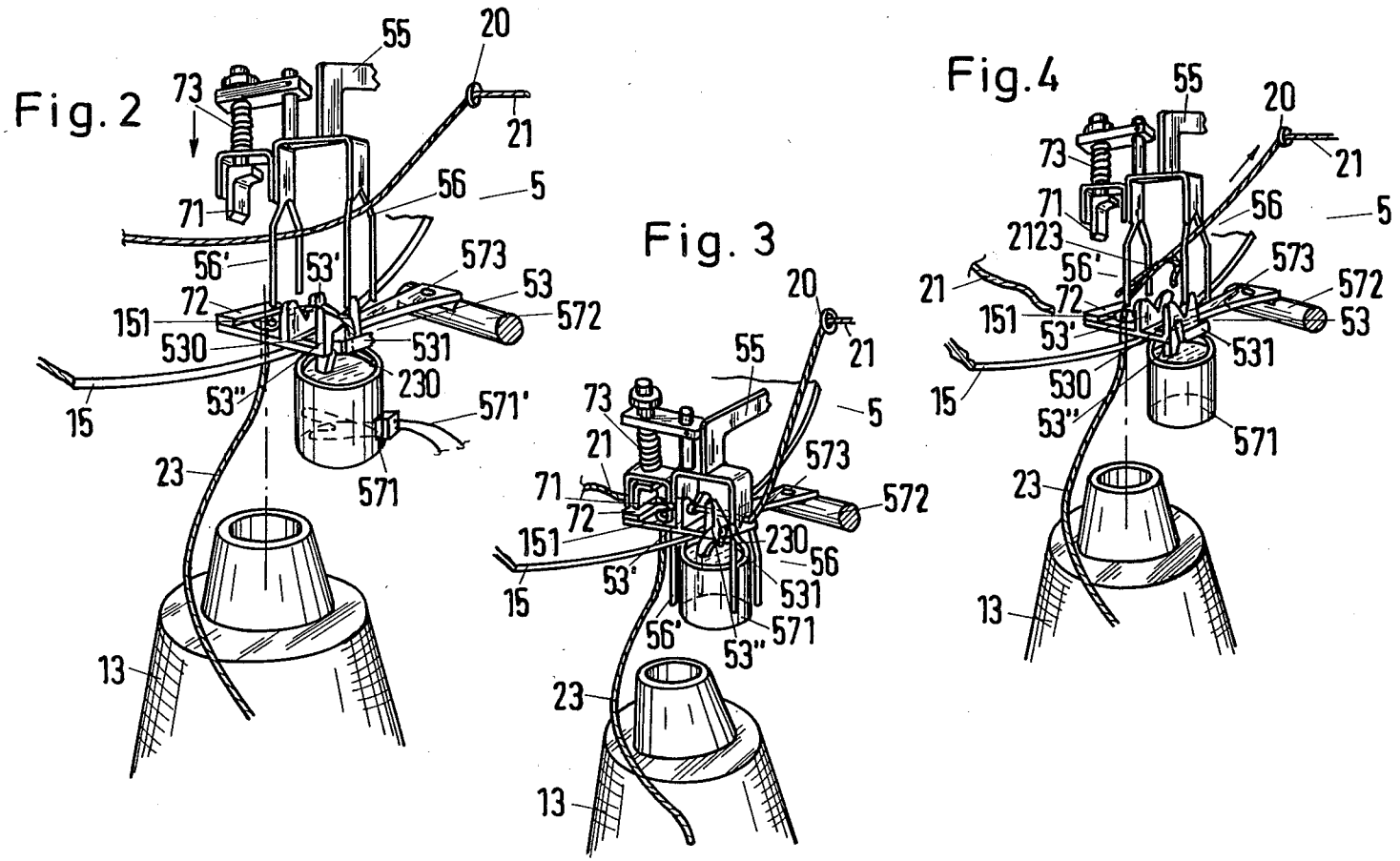
FIG. 2 illustrates an enlarged view of a piecing-up means in accordance with the invention.
FIG. 3 illustrates the piecing-up means of FIG. 2 during the severing of a delivery bobbin yarn and the securement of the yarn ends to be joined together.
FIG. 4 illustrates the piecing-up means of FIG. 2 after severance and piecing-up of the yarns.

Referring to FIG. 2, the piecing-up means is responsive to the control means 61 for piecing-up the yarn 23 from the reserve bobbin 13 with the yarn 21 from the delivery bobbin 11 in response to an adjustable minimum quantity of weft yarn being reached on the delivery bobbin 11. As illustrated, in addition to the yarn retaining element 53 for holding a distal end of the weft yarn 23, the piece-up means includes a movably mounted stirrup assembly 5 for guiding the weft yarn 21 from the delivery bobbin 11.

The stirrup assembly 5, as shown in FIG. 1 includes an electromagnetic linear piston drive 555 which is secured to an arm 50 and which has a piston rod 555' which carries a yoke 55. The yoke 55, in turn, carries a pair of guide stirrups 56, 56', each of which has a forked end for guiding a weft yarn 21, 21', respectively.

Referring to FIG. 2, the weft yarn 21 from the delivery bobbin extends through the guide stirrups 56, 56' and is disposed in parallel relationship with the yarn 23 retained in the retaining element 53. In addition, the piecing-up means includes a paraffin reservoir 571 adjacent the retaining element 53 for applying paraffin to the weft yarn 23 retained in the retainer element 53 for bonding to the weft yarn 21 in the stirrups 56, 56' upon contact therewith. In addition, a heater in the form of a electrical heating facility 571' is provided for liquifying the paraffin in the reservoir 571 since the paraffin is otherwise solid at ambient temperature. As indicated, a bent arm 573 secured to a rotatable bar 572 may be dipped into the liquid paraffin 570 in the reservoir 571 in order to transfer the liquid paraffin to the yarn 23. To this end, an aperture 530 is provided in the retaining element 53 to permit passage of the bent end of the arm 573. The bar 572 is driven, for example by a linear piston 574 (see FIG. 5) having a rod which drives an eccentric cam 575 secured to the bar 572.

Alternatively, the piecing-up means may include an adhesive applying means adjacent the retainer element for applying adhesive to the weft yarn 23 for adhesively bonding to the weft yarn 21 upon contact therewith.

Referring to FIG. 2, a yarn severing device is also provided for severing the weft yarn 21 from the delivery bobbin downstream of the point of connection with the weft yarn 23 from the reserve bobbin 13. As indicated, the severing device includes a blade 71 which is mounted on the stirrup assembly 5 and an anvil 72 on a radially inwardly directed projection of the retaining element 53. The yarn 21 which is to be severed moves between the anvil 72 and the blade 71. In addition, the blade 71 is biased by a spring 73 and is secured on the radially inward side of the yarn 55.

During operation, the joining of the yarns 21, 23 of the delivery bobbin 11 and reserve bobbin 13 and the severance of the delivery bobbin yarn 21 occur when the reserve bobbin 13 has moved by means of the turntable 14 into the position of the previous bobbin 11 (FIG. 2). The yoke 55 is then lowered by actuation of the linear piston 555 into the position illustrated in FIG. 3. During this time, the forked guide stirrups 56, 56' retain and secure the ends of the yarns 21, 23 in the guide teeth of the retaining element 53. At the same time, the blade 71 strikes the anvil 72 and severs the yarn 21 between the delivery bobbin 11 and the guide tooth 53'.

As shown in FIG. 3, the bar 572 is rotated so as to dip the arm 573 into the reservoir and then rotates in the opposite direction to move the arm 573 into contact with the two yarns 21, 23 to be pieced-up and scrap some of the paraffin thereon onto the yarns 21, 23. In this respect, the linear piston 574 is actuated with the piecing-up means 5 to perform the piecing-up operation, that is, the sticking together of the two yarn ends with paraffin.

After severance and piecing up, the piston 555 with the yoke 55 and guide stirrups and blade 71 return to the initial position as illustrated in FIG. 4. The yarns 21, 23 of the respective bobbins 11, 13 are thus pieced together at a connection place 2123 and the bobbin 13, previously the reserve bobbin—has become the new delivery bobbin. The severed yarn on the delivery bobbin thus becomes residual yarn. The end of the yarn 21 which has been connected to the distal end of the yarn 23 extends through the yarn guide 20 to the loom (not shown). The weft yarn can then be blown by the nozzle 44 (FIG. 1) up to and including the connection place 2123 into the duct 40 as waste. After the yarn 23 of the new delivery bobbin 13 has been cut off by a further severing device (not shown), the loom may be restarted.

Referring to FIG. 1, the linear piston 555 is controlled by the control means 61 via a line 655 while the linear piston 574 for driving the rotatable bar 572 is actuated via a line 674. At the same time, the control means 61 can be used to energize both pistons 555, 574.

The piecing-up of the yarns may be affected with the use of other adhesives, such as a rapid-hardening adhesive. Piecing-up by means of a device for melting the yarns would also be suitable for yarns made of materials, such as nylon or other plastics. Alternatively, the yarns could be pieced-up by a mechanical device, such as a knotter or splicer.

The severing means for severing the yarn may alternatively be constructed of a blade with a self-contained magnet drive or by a shears. Further, it may be possible to provide a mechanical tensioning device for the blade which releases the blade only after the yoke 55 has descended so that the spring presses the blade onto the anvil to sever the yarn between the blade and the anvil.

As noted above, the second weft bobbin changer 1′ is of substantially identical construction to the changer 1. Of note, in the event of a changing operation in just one of the changers, the movements of the common parts of the piecing-up means, such as the yoke 55, and the parts connected thereto are readily possible. An independent control or a joint operation may also be provided for the two changers. Finally, a bobbin magazine other than the rotating bobbin turntable arrangement having the discs 14, 15 may be used.

The invention thus provides a weft bobbin changer which is able to operate on an automated basis in a reliable manner with a minimum of yarn waste.

What is claimed is:

1. A weft bobbin changer for a loom comprising
a delivery bobbin for supplying a weft yarn;
at least one reserve bobbin containing a weft yarn;
a sensor responsive to the quantity of weft yarn on said delivery bobbin;
control means connected to said sensor, said control means being responsive to a signal from said sensor corresponding to an adjustable minimum quantity of yarn on said delivery bobbin to emit a stop signal to stop the loom;
piecing-up means responsive to said control means for piecing-up a yarn from said reserve bobbin with a yarn from said delivery bobbin in response to said adjustable minimum quantity of weft yarn being reached on said delivery bobbin; and
a yarn severing device for severing the weft yarn from said delivery bobbin downstream of a point of connection with the weft yarn from said reserve bobbin.

2. A changer as set forth in claim 1 wherein said control means is responsive to a piecing-up of a yarn from said reserve bobbin to a yarn from said delivery bobbin to emit a start signal to re-start the loom.

3. A changer as set forth in claim 1 wherein said control means is responsive to said stop signal to actuate said piecing-up means.

4. A changer as set forth in claim 2 wherein said control means is responsive to a piecing-up of a yarn from said reserve bobbin to a yarn from said delivery bobbin to emit a start signal to re-start the loom.

5. A changer as set forth in claim 1 wherein said piecing-up means includes an adhesive applying means for applying adhesive to the yarns to be pieced-up.

6. A changer as set forth in claim 1 wherein said piecing-up means includes a paraffin applying means for applying paraffin to the yarns to be pieced-up.

7. A changer as set forth in claim 1 which further comprises a turntable having skewers for mounting said bobbins thereon.

8. A weft bobbin changer for a loom comprising
a delivery bobbin for supplying a weft yarn;
at least one reserve bobbin containing a weft yarn; and
piecing-up means for piecing-up a yarn from said reserve bobbin with a yarn from said delivery bobbin in response to an adjustable minimum quantity of weft yarn being reached on said delivery bobbin, said piecing-up means including a yarn retaining element adjacent said reserve bobbin for holding a distal end of a weft yarn therein and a movably mounted stirrup assembly for guiding a weft yarn from said delivery bobbin therein.

9. A changer as set forth in claim 8 wherein said piecing-up means further includes means for moving a distal end of a weft yarn in said retainer element into parallel contact with a weft yarn in said stirrup assembly.

10. A changer as set forth in claim 9 wherein said piecing-up means further includes an adhesive applying means for applying adhesive to the weft yarn retained in said retainer element for adhesively bonding to the weft yarn in said stirrup assembly upon contact therewith.

11. A changer as set forth in claim 9 wherein said piecing-up means further includes a paraffin reservoir adjacent said retainer element for applying paraffin to the weft yarn retained in said retainer element for bonding to the weft yarn in said stirrup assembly upon contact therewith and a heater for liquifying paraffin in said reservoir.

12. A changer as set forth in claim 8 which further comprises a yarn severing device for severing the weft yarn from said delivery bobbin downstream of a point of connection with the weft yarn from said reserve bobbin.

13. A changer a set forth in claim 9 wherein said means for moving is a turntable having said bobbins and said retaining element mounted thereon.

14. A weft bobbin changer for a loom comprising
a turntable having skewers thereon for receiving a delivery bobbin of weft yarn and at least one reserve bobbin of weft yarn;
a sensor responsive to the quantity of weft yarn on the delivery bobbin;
control means connected to said sensor for responding to a signal from said sensor indicating a minimum quantity of yarn on the delivery bobbin; and
piecing-up means responsive to said control means for piecing-up a yarn from the reserve bobbin with a yarn from the delivery bobbin in response to said signal, said piecing-up means including a yarn retaining element adjacent said reserve bobbin for holding a distal end of a weft yarn therein and a movably mounted stirrup assembly for guiding a weft yarn from said delivery bobbin therein.

15. A weft bobbin changer as set forth in claim 14 wherein said piecing-up means further includes means for moving said stirrup assembly towards said retainer element to move a weft yarn in said stirrup assembly into parallel contact with a distal end of a weft yarn in said retainer element.

16. A weft bobbin changer as set forth in claim 15 wherein said piecing-up means further includes an adhesive applying means for applying adhesive to the weft yarn retained in said retainer element for adhesively bonding to the weft yarn in said stirrup assembly upon contact therewith.

17. A weft bobbin changer as set forth in claim 15 wherein said piecing-up means further includes a paraffin reservoir adjacent said retainer element for applying paraffin to the weft yarn retained in said retainer element for bonding to the weft yarn in said stirrup assembly upon contact therewith and a heater for liquifying paraffin in said reservoir.

18. A changer as set forth in claim 15 wherein said means for moving is a turntable having said bobbins and said retaining element mounted thereon.

19. A weft bobbin changer as set forth in claim 14 wherein a yarn severing device for severing the weft yarn from said delivery bobbin downstream of a point of connection with the weft yarn from said reserve bobbin.

20. A weft bobbin changer for a loom comprising a turntable having a plurality of skewers for mounting a delivery bobbin for supplying a weft yarn and at least one reserve bobbin containing a weft yarn;

a sensor responsive to the quantity of weft yarn on said delivery bobbin;

control means connected to said sensor;

piecing-up means including a paraffin applying means responsive to said control means for applying paraffin to piece-up a yarn from said reserve bobbin with a yarn from said delivery bobbin in response to an adjustable minimum quantity of weft yarn being reached on said delivery bobbin; and a yarn severing device for severing the weft yarn from said delivery bobbin downstream of a point of connection with the weft yarn from said reserve bobbin.

21. A changer as set forth in claim 20 wherein said control means is responsive to a signal from said sensor corresponding to said minimum quantity of yarn on said delivery bobbin to emit a stop signal to stop the loom and to actuate said piecing-up means.

* * * * *